US012005286B2

(12) United States Patent
Bower

(10) Patent No.: US 12,005,286 B2
(45) Date of Patent: Jun. 11, 2024

(54) DEVICE AND METHOD FOR ESTIMATING A RESISTANCE OF A WHEEL OF A STATIONARY BICYCLE

(71) Applicant: Daniel Bower, Conifer, CO (US)

(72) Inventor: Daniel Bower, Conifer, CO (US)

( * ) Notice: Subject to any disclaimer, the term of this patent is extended or adjusted under 35 U.S.C. 154(b) by 194 days.

(21) Appl. No.: 17/733,917

(22) Filed: Apr. 29, 2022

(65) Prior Publication Data

US 2022/0355151 A1 Nov. 10, 2022

Related U.S. Application Data

(60) Provisional application No. 63/186,075, filed on May 8, 2021.

(51) Int. Cl.

| | |
|---|---|
| ***A63B 21/00*** | (2006.01) |
| ***A63B 22/06*** | (2006.01) |
| ***A63B 71/06*** | (2006.01) |

(52) U.S. Cl.

CPC .... *A63B 21/00069* (2013.01); *A63B 22/0605* (2013.01); *A63B 2071/0694* (2013.01)

(58) Field of Classification Search

CPC ..... A63B 21/00069; A63B 22/0605; A63B 2071/0694; A63B 71/0619; A63B 2071/0675

See application file for complete search history.

(56) References Cited

U.S. PATENT DOCUMENTS

| | | | | |
|---|---|---|---|---|
| 11,298,583 | B2 * | 4/2022 | Hsieh | A63B 22/0605 |
| 2010/0009815 | A1 * | 1/2010 | Chen | A63B 21/015 482/63 |
| 2018/0207468 | A1 * | 7/2018 | Golesh | A63B 22/0605 |
| 2020/0001129 | A1 * | 1/2020 | Hsieh | A63B 21/015 |

FOREIGN PATENT DOCUMENTS

| | | | | |
|---|---|---|---|---|
| WO | WO-2022023767 | A1 * | 2/2022 | A63B 21/00058 |

* cited by examiner

*Primary Examiner* — Andrew S Lo
(74) *Attorney, Agent, or Firm* — Kumar Maheshwari; Mahesh Law group PC

(57) ABSTRACT

A device and method for estimating a resistance of a wheel of a bicycle is disclosed. The device includes a mounting bracket, a disk, and a resistance adjustment knob. The mounting bracket is coupled to the bicycle. The disk is configured to indicate the resistance. The disk is located within the mounting bracket. The resistance adjustment knob is connected to the disk via a connector. Upon rotation of the knob, the connector rotates the disk for estimating the resistance of the wheel of the bicycle. The determined estimated resistance is visible on the disk.

20 Claims, 15 Drawing Sheets

DEVICE AND METHOD FOR ESTIMATING A RESISTANCE OF A WHEEL OF A STATIONARY BICYCLE

CROSS REFERENCE TO PRIOR APPLICATION

This application claims the benefit of U.S. Provisional Patent Application No. 63/186,075, entitled as "Exercise Bike Resistance Estimate Indicator", filed May 8, 2021, which is incorporated by reference in its entirety.

FIELD OF THE INVENTION

This disclosure relates to the field of stationary exercise bicycles. More specifically, the field relates to a stationary exercise bicycle with a vertically mounted resistance adjustment knob mounted on a post and with no built-in resistance estimation gage to provide the user with an estimate of resistance during exercise.

BACKGROUND

Exercise utilizing a stationary bicycle, also known as an exercise bike, is a helpful and popular activity. Stationary bicycles with a vertically mounted resistance adjustment knob enable the user to decrease or increase a resistance level during exercise by moving a physical shoe or a magnetic shoe closer to or farther away from the exercise wheel or a friction pad pressure against the exercise wheel. Users can burn 500 or more calories per session on a stationary bicycle. Users often use these types of exercise equipment while participating in instructor led virtual or in person classes.

Virtual instructors typically provide resistance levels for students in specific levels that equate to percentages of maximum resistance. For example, instructors will request "25-30 resistance" or request an incremental change of X percentage resistance ("add 4-6 resistance"). A basic stationary bicycle with the resistance adjustment knob will often lack any gage to indicate selected resistance. The average person using a stationary exercise bicycle would have to exercise considerably longer to achieve the same fitness benefit if used lower than desired resistance or reduce the fitness benefit achieved if they are not adjusting the resistance knob to the correct level. When the objective of exercise is increasing health benefit and minimizing the time required, an estimate of the resistance level configured at each moment of stationary bicycle use adds significant value to the exercise experience.

Thus, there is need of a solution in which resistance levels can be estimated when a user is riding the stationary bicycle and the estimated resistance levels are visible to the user while riding the bicycle.

SUMMARY

The present disclosure discloses a device for determining a resistance of a wheel of a bicycle. The device includes a mounting bracket, a disk, and a rubber band connection to the post under the bike resistance adjustment knob. The mounting bracket is coupled to the bicycle. The disk is configured to indicate the resistance. The disk is located within the mounting bracket. The resistance adjustment knob post is connected to the disk via a connector. Upon rotation of the knob, the connector rotates the disk for estimating the resistance of the wheel of the bicycle. The determined estimated resistance is visible on the disk.

In accordance with the aspects of the disclosure, the device further includes a post that is configured to pass through a mounting hole in the mounting bracket and a center hole in the disk, for securing the disk in place. Alternate designs may not require a post to attach the disk to the mounting bracket.

In accordance with the aspects of the disclosure, the mounting bracket is designed as a single plastic unit.

In accordance with the aspects of the disclosure, the connector is a zip-tie, a rubber band, a string, or a combination thereof.

In accordance with the aspects of the disclosure, the mounting bracket is coupled to the handlebar post of the bicycle using a fastener.

In accordance with the aspects of the disclosure, the fastener is a zip-tie, a rubber band, a string, or a combination thereof.

In accordance with the aspects of the disclosure, upon rotation of the bike resistance knob, the disk simultaneously rotates in a same rotation direction as the knob.

In accordance with the aspects of the disclosure, an outside edge of a top portion of the disk includes equally spaced visible numeral markers ranging from ten to hundred, each numeral marker separated by nine evenly spaced raised marker dots. The numeral markers and marker dots correspond to resistance values of the wheel.

In accordance with the aspects of the disclosure, the device further includes a pointer arrow. The pointer arrow is positioned parallelly above the visible numeral markers on the top portion of the disk.

In accordance with the aspects of the disclosure, during rotation of the knob, the visible numeral marker aligned with the pointer arrow corresponds to the estimated resistance of the wheel that is visible to a user.

In accordance with the aspects of the disclosure, the resistance of the wheel can be adjustable by adjusting a baseline of the connector (starting number shown on the disk) and by rotating the knob based on a comfort of the user while riding the bicycle.

The present disclosure also relates to a device for estimating a resistance of a wheel of the bicycle. The device includes a mounting bracket, a disk, a pointer arrow, and a resistance adjustment knob. The mounting bracket is configured to be coupled to the bicycle. The disk is configured to indicate the resistance and is configured to be connected to a resistance adjustment knob on the bicycle via a connector. The disk is located inside the mounting bracket. The pointer arrow is configured to be attached to the mounting bracket. The pointer arrow is positioned parallelly above the disk. An outside edge of a top portion of the disk includes equally spaced visible numeral markers ranging from ten to hundred. Each numeral marker is separated by nine evenly spaced raised marker dots. The numeral markers and marker dots correspond to resistance values of the wheel. Upon rotation of the knob, the connector rotates the disk. The visible numeral marker aligned with the pointer arrow corresponds to the estimated resistance of the wheel that is visible on the disk.

In accordance with the aspects of the disclosure, the mounting bracket is designed as a single plastic unit.

In accordance with the aspects of the disclosure, the connector is a zip-tie, a rubber band, a string, or a combination thereof.

In accordance with the aspects of the disclosure, the mounting bracket is coupled to the handlebar post of the bicycle using a fastener.

In accordance with the aspects of the disclosure, the fastener is a zip-tie, a rubber band, a string, or a combination thereof.

In accordance with the aspects of the disclosure, upon rotation of the knob, the disk simultaneously rotates in a same rotation direction as the knob.

In accordance with the aspects of the disclosure, the resistance of the wheel can be adjustable by adjusting a baseline of the connector (starting number shown on the disk) and by rotating the knob based on a comfort of the user while riding the bicycle.

The present disclosure also discloses a method for estimating a resistance of a wheel of the bicycle. The method includes coupling a mounting bracket to a handlebar post of the bicycle, placing a disk that is configured to indicate the resistance inside the mounting bracket, and attaching a pointer arrow to the mounting bracket. The pointed arrow is positioned parallelly above the disk. The method further includes passing a post through a mounting hole in the mounting bracket and a center hole in the disk, for securing the disk in place. The method further includes connecting a resistance adjustment knob to the disk via a connector. An outside edge of a top portion of the disk comprises equally spaced visible numeral markers ranging from ten to hundred, each numeral marker separated by nine evenly spaced raised marker dots. The numeral markers and marker dots correspond to resistance values of the wheel. In addition, the method further includes rotating the knob for estimating the resistance of the wheel. Upon rotation, the connector rotates the disk and the visible numeral marker aligned with the pointer arrow corresponds to the estimated resistance of the wheel that is visible on the disk.

DETAILED DESCRIPTION

Embodiments, of the present disclosure, will now be described with reference to the accompanying drawing.

Embodiments are provided so as to convey the scope of the present disclosure thoroughly and fully to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, elements, modules, units and/or components, but do not forbid the presence or addition of one or more other features, elements, components, and/or groups thereof. The particular order of steps disclosed in the method and process of the present disclosure is not to be construed as necessarily requiring their performance as described or illustrated. It is also to be understood that additional or alternative steps may be employed.

Figure 1A:
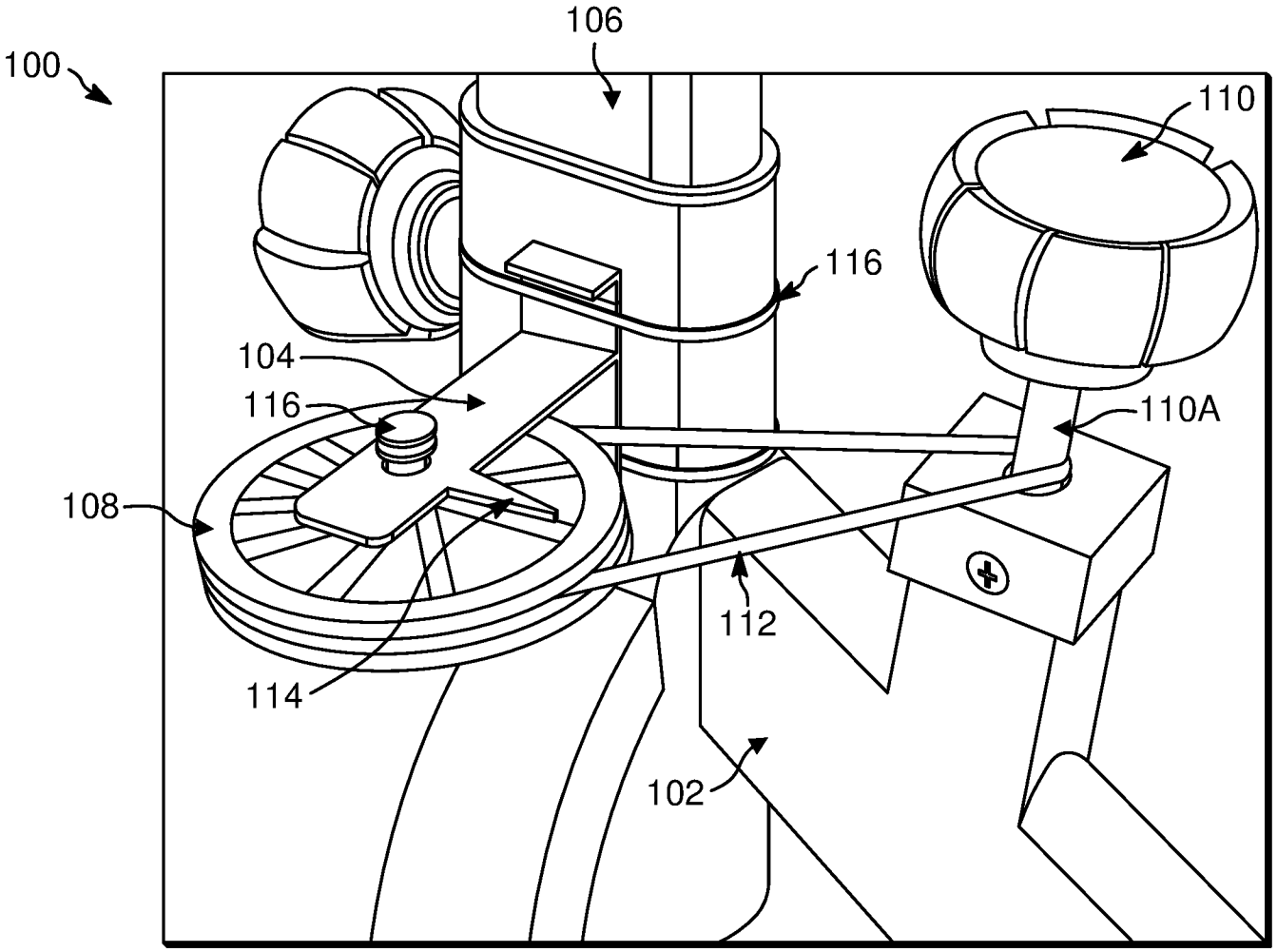
FIG. 1*a* illustrates a perspective view of the device, in accordance with an embodiment of the present disclosure.
Figure 1B:
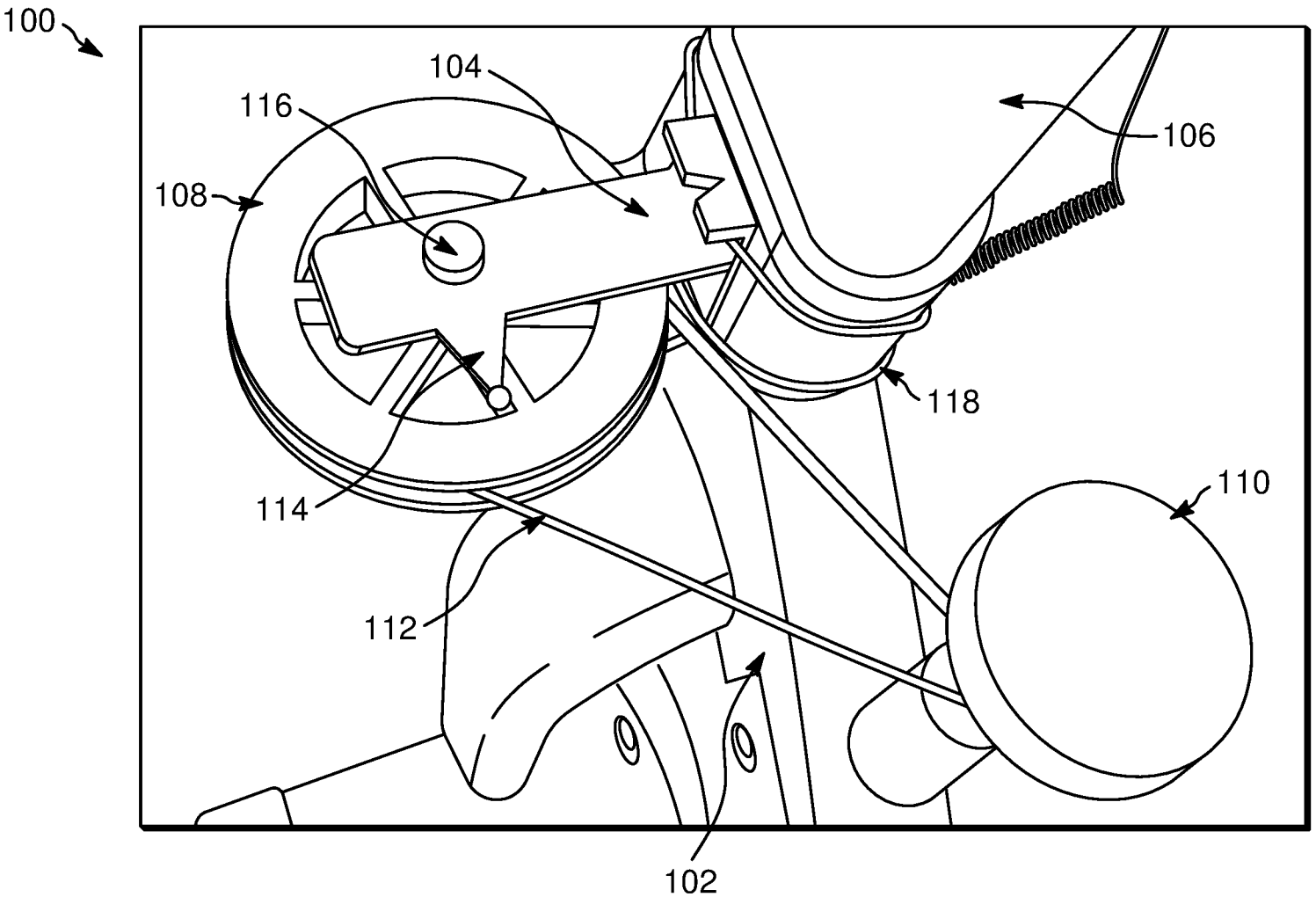
FIG. 1*b* illustrates a left-side view of the device, in accordance with an embodiment of the present disclosure.
Figure 1C:
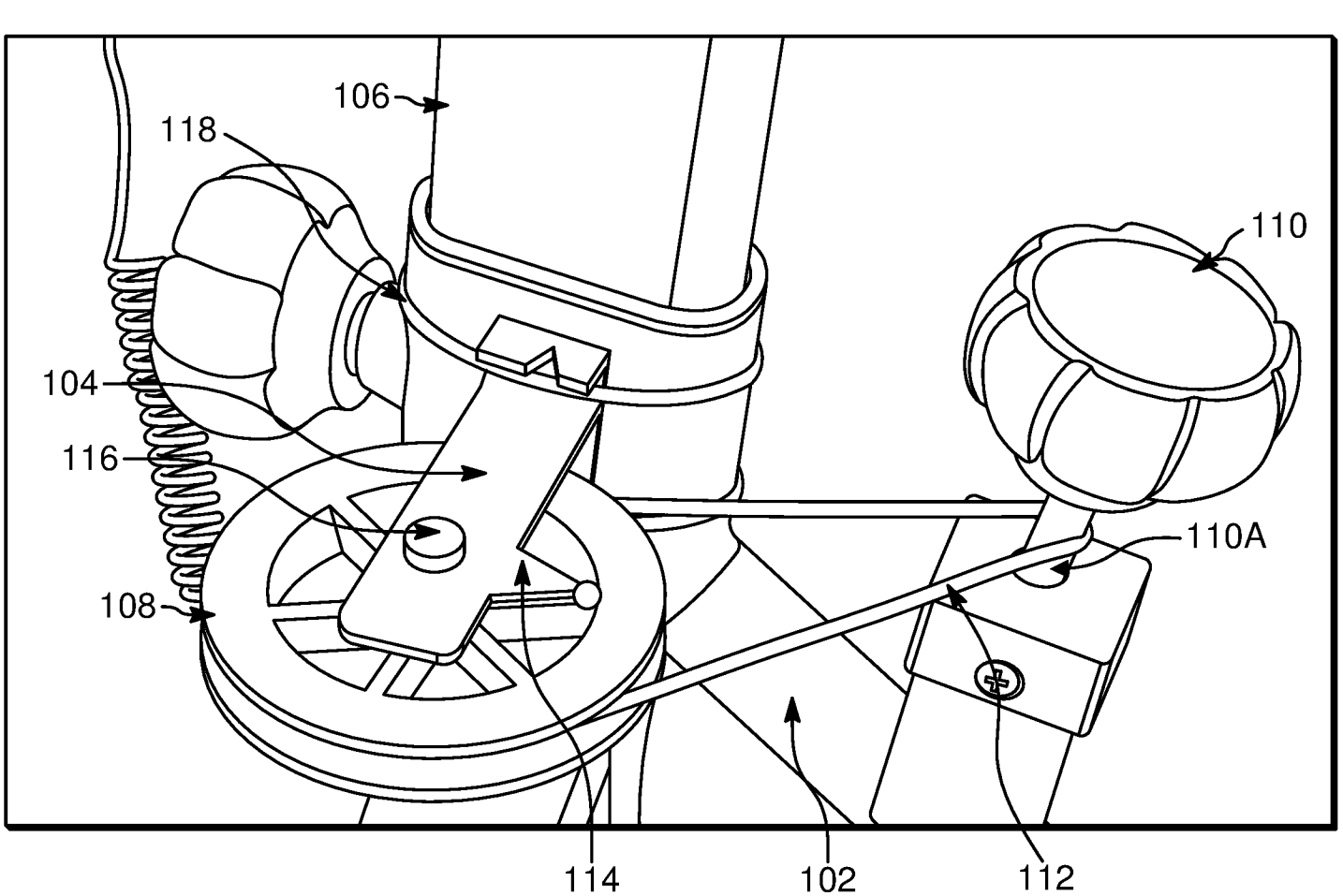
FIG. 1*c* illustrates a right-side view of the device, in accordance with an embodiment of the present disclosure.
Figure 1D:
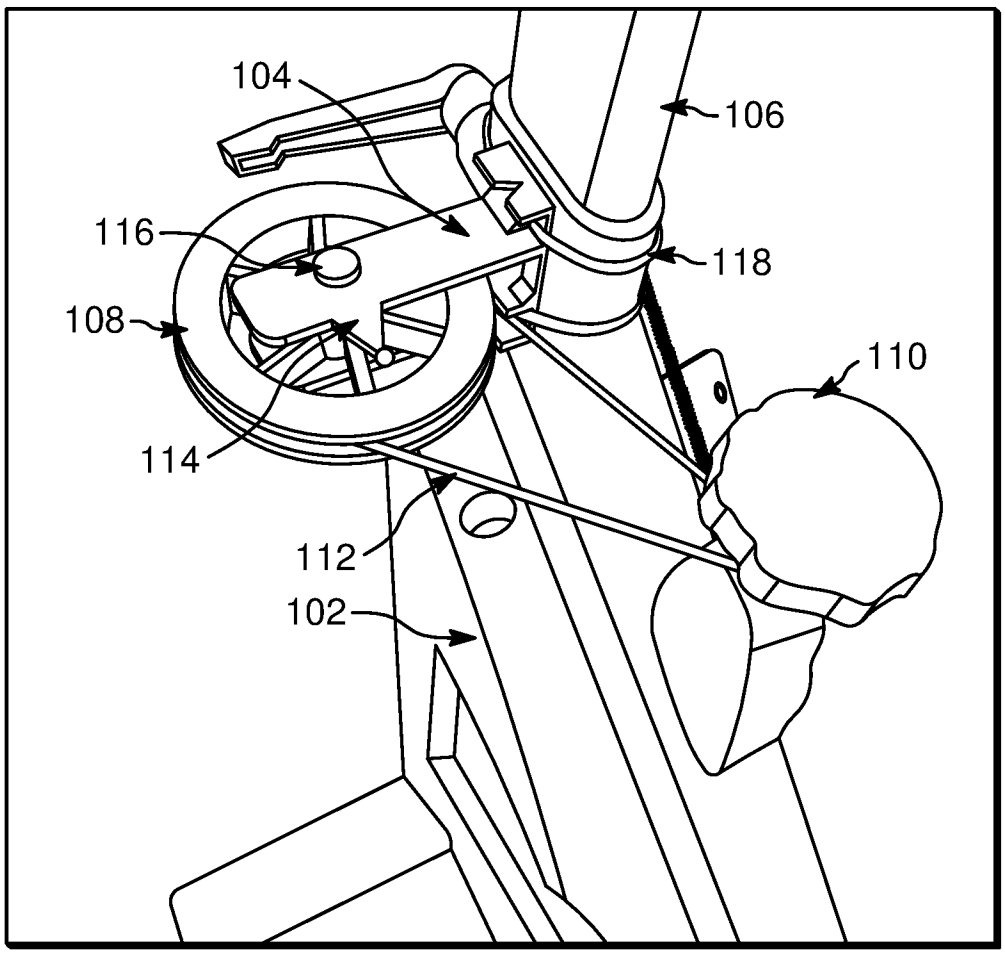
FIG. 1*d* illustrates a top view of the device, in accordance with an embodiment of the present disclosure.

FIGS. 1*a*-1*b* illustrate different views of a device 100 for estimating a resistance of the wheel of a bicycle 102. In an example, the bicycle 102 may be a stationary exercise bicycle. The resistance may be estimated for a front wheel of the bicycle 102 or a rear wheel of the bicycle 102. FIG. 1*a* illustrates a perspective view of the device, FIG. 1*b* illustrates a left-side view of the device, FIG. 1*c* illustrates a right-side view of the device, and FIG. 1*d* illustrates a top view of the device, in accordance with an embodiment of the present disclosure. As shown, the device 100 includes a mounting bracket 104, a disk 108, and a resistance knob 110.

In an embodiment, the mounting bracket 104 is a single plastic unit, designed to align the disk 108 at a proper angle with the knob 110. The disk 108 and the knob 110 are both placed diagonal to each other. The mounting bracket 104 includes a pointer arrow 114 on its top surface. The pointer arrow 114 is aligned with a center rotation point of the disk 108. The mounting bracket 104 is coupled to a handlebar post 106 of the bicycle 102 using a fastener. In an example, the fastener may be a zip-tie, a string, a rubber band, and the like. The device 100 further includes a post 116 that enables the mounting bracket 104 and the disk 106 to stay securely in place.

In an embodiment, the disk 108 is configured to indicate the resistance of the wheel of the bicycle 102. The disk 108 is located inside of the mounting bracket 104. For instance, the disk 108 may be of a circular cross section shape. The disk 108 rotates freely on a horizontal axis inside of the mounting bracket 104. The disk 108 is connected to the resistance knob 110 via a connector 112. In an example, the connector 112 may be a zip-tie, a string, a rubber band, and the like to allow flexible consistent connection to the resistance knob post. The knob 110 may be vertically mounted in front of the handlebar post 106. The knob 110 is attached to the bicycle 102 using a bike resistance knob post 110A. In an example, the bike resistance knob post 110A may be made using metal. One end of the connector 112 is wrapped around the resistance knob post 110A and another end of the connector 112 is wrapped around a center pulley of the disk 108. Revolutions of the knob 110 are transferred to the disk 108 via the connector 112. In this way, the connector 112 is flexible and may be easily stretchable.

In an embodiment, upon rotation of the knob 110, the connector 112 applies a force that rotates the disk 108. The connector 112 spins the disk 108 on which an estimated resistance of the wheel of the bicycle 102 is visible to a user/rider of the bicycle 102. Around 3 to 12+ rotations of the knob 110 translates to one full rotation of the disk 108. The number of rotations varies per bicycle 102. Also, around 3 to 12 + rotations of the knob 110 is required to reach a maximum resistance of the wheel with which the user can ride the bicycle 102. Further, the disk 108 and the knob 110 both simultaneously rotate in a same rotation direction. For instance, if the knob 110 rotates in a clockwise direction, the disk 108 also rotates in the clockwise direction. If the knob 110 is rotated in a counterclockwise direction, the disk 108 also rotates in the counterclockwise direction. Also, a speed at which the disk 108 and the knob 110 rotate are nearly equivalent to each other. Details on how the resistance of the wheel is estimated based on the knob 110 and the disk 108 rotation is explained in the below figures.

Figure 2:
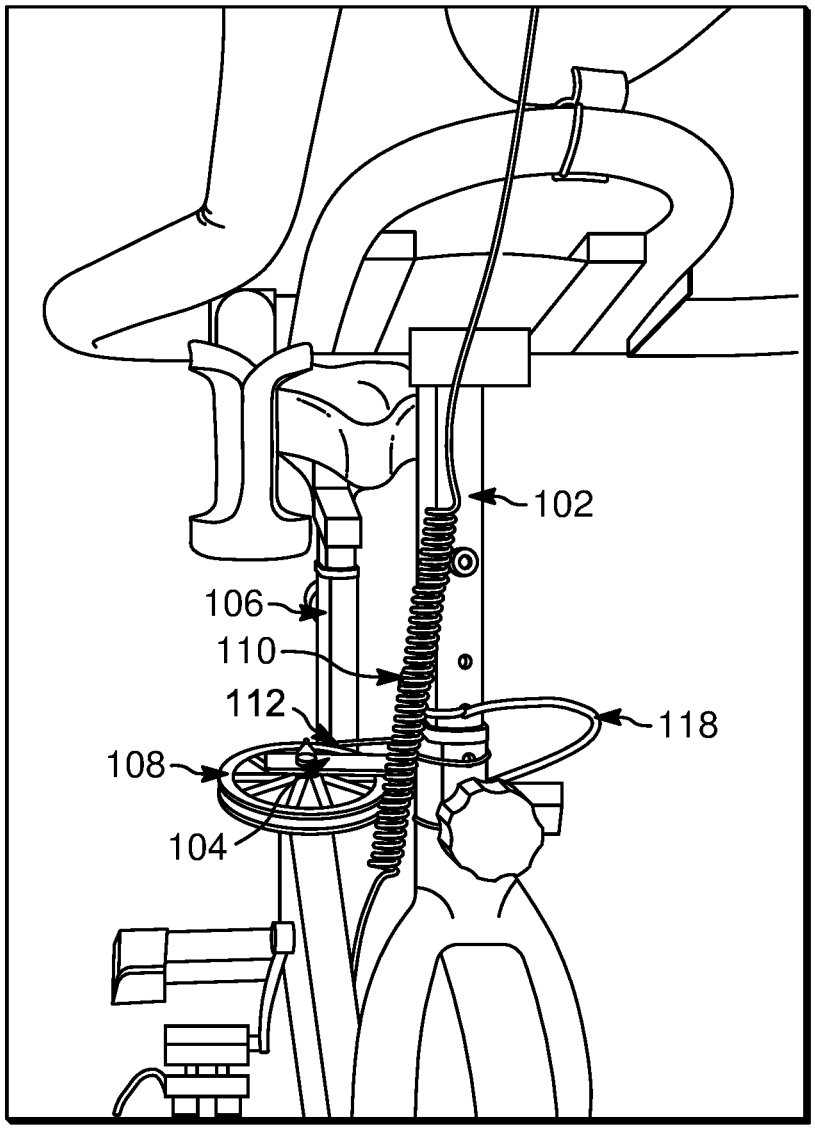
FIG. 2 illustrates a front view of a bicycle in which the device is mounted to, in accordance with an embodiment of the present disclosure.

FIG. 2 illustrates a front view of the bicycle 102 in which the device 100 is mounted to, in accordance with an embodiment of the present disclosure. The mounting bracket 104 may be coupled to a left side of the handlebar post 106 or a right side of the handlebar post 106. The knob 110 that is connected to the disk 108 via the connector 112 is generally placed between the handlebar post 106 and a front handle of the bicycle 102. In this way, the user may easily rotate the knob 110 as it is present in front of the user, and easily view the estimated resistance value displayed on the disk 108, which is right beside the user. Also, the user may easily change the resistance of the wheel by rotating the knob 110 while riding the bicycle 102. Thus, the user does not have to get out his/her seat to change the resistance of the wheel and can change the resistance simultaneously while riding the bicycle 102. This is mainly advantageous for users who are viewing virtual classes, as they will easily be able to change resistance levels while riding.

Figure 3:
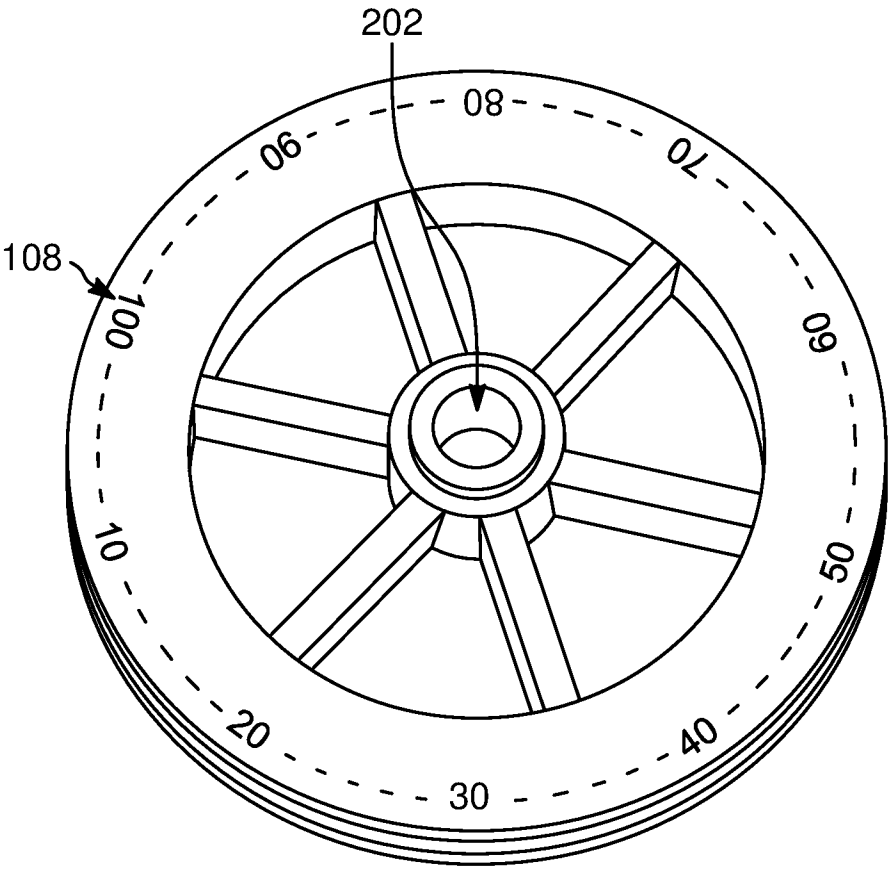
FIG. 3 illustrates a top view of a disk of the device, in accordance with an embodiment of the present disclosure.

FIG. 3 illustrates a top view of the disk 108 of the device 100, in accordance with an embodiment of the present disclosure. In an embodiment, an outside edge of a top portion of the disk 108 includes equally spaced numeral markers. The equally spaced numeral markers range from the number 10 to the number 100. Thus, there a total of ten equally spaced numeral markers. Each numeral marker is separated by nine evenly spaced raised marker dots. The numerical markers and marker dots correspond to resistance values of the wheel of the bicycle 102. The numeral markers and marker dots are highlighted in black for better visibility.

Figure 4:
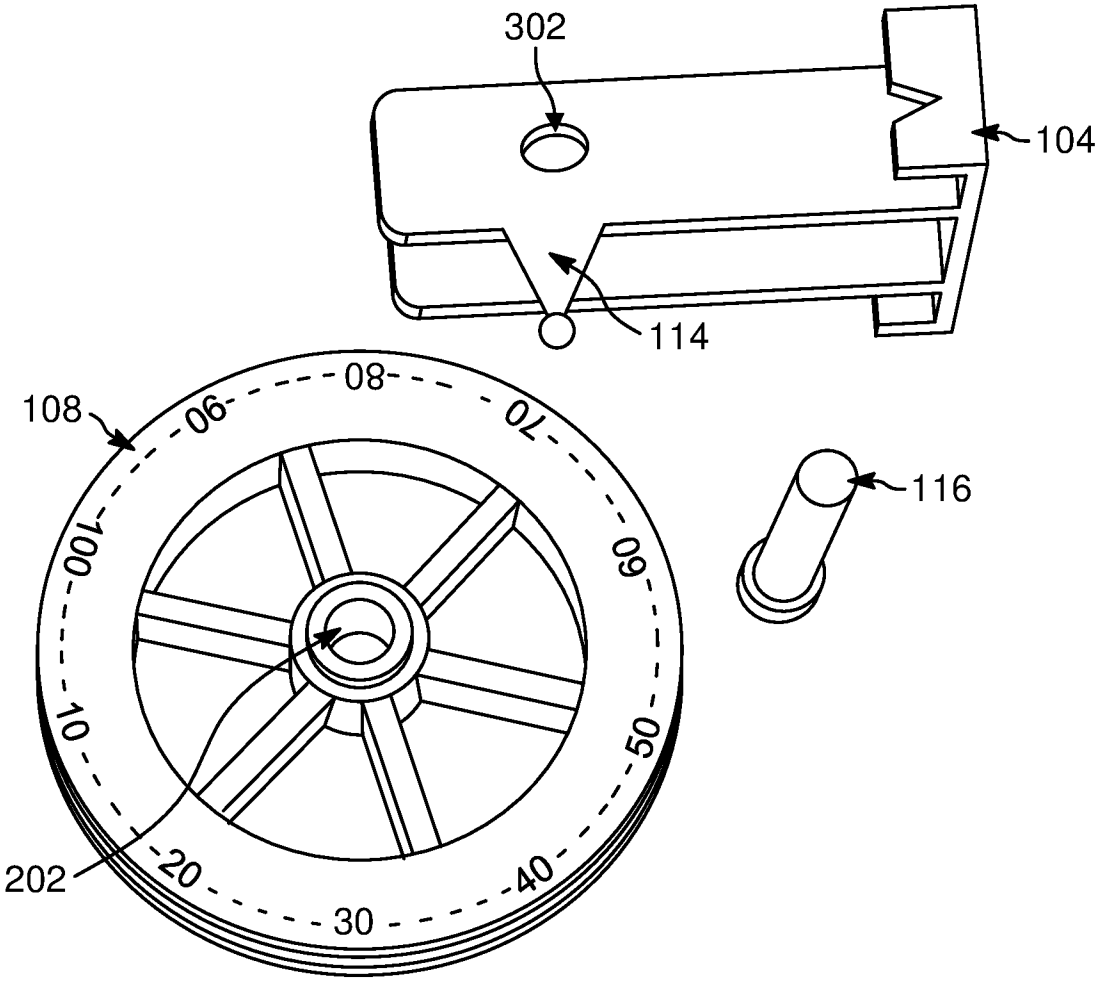
FIG. 4 illustrates a mounting bracket and the disk, in accordance with an embodiment of the present disclosure.

FIG. 4 illustrates the mounting bracket 104 and the disk 108, in accordance with an embodiment of the present disclosure. As shown, the disk 108 includes a center hole 202 and the mounting bracket 104 includes a mounting hole 302. The disk 108 is duly secured in its place via the post 116. For instance, the post 116 may be of a pin cylindrical shape. The post 116 is configured to be passed through the mounting hole 302 in the mounting bracket 104 and the center hole 202 in the disk 108. Such passing of the post 116 enables the disk 108 and the mounting bracket 104 to be held tightly in place.

Figure 5A:
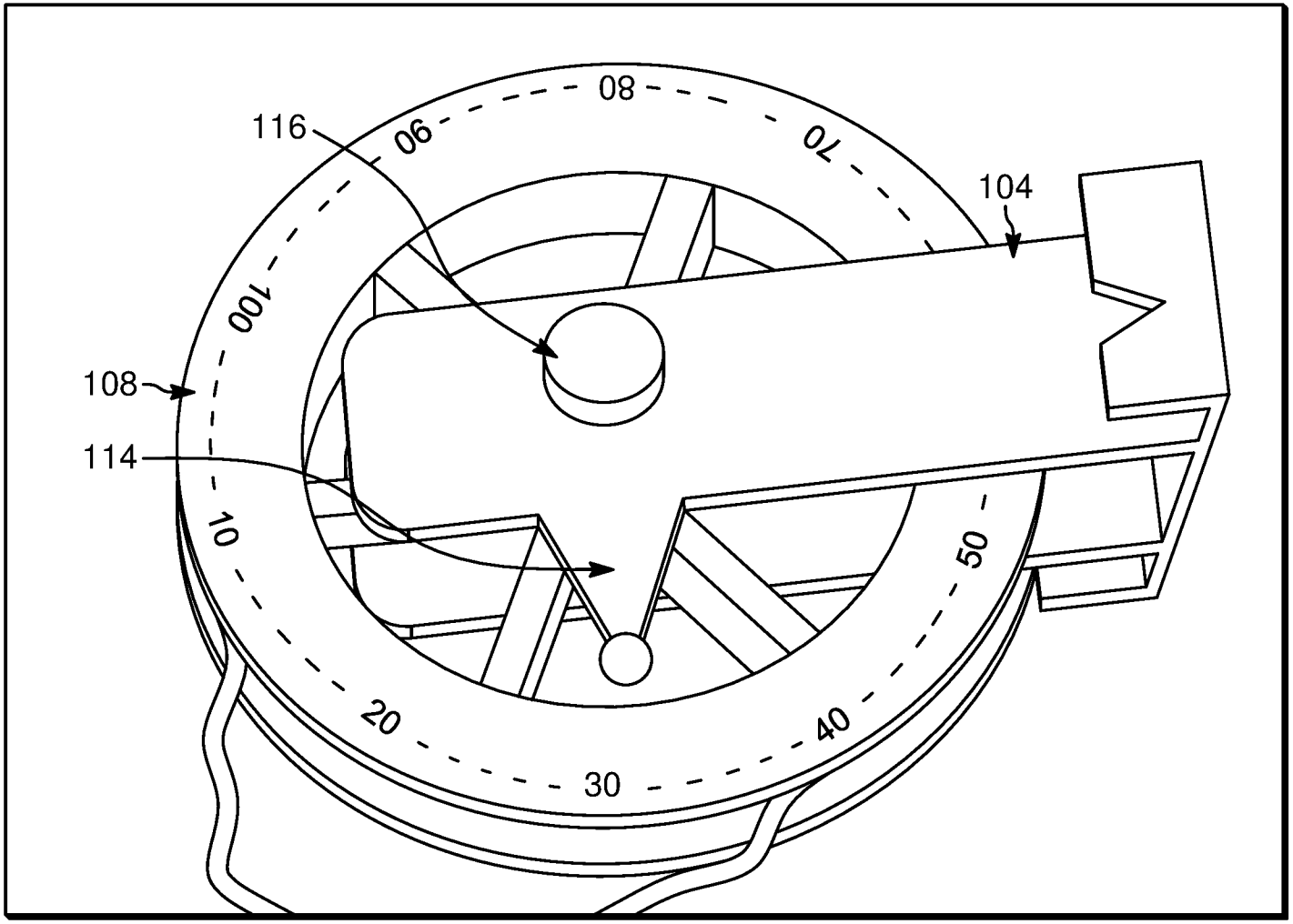
FIG. 5A illustrates a top view of the disk secured inside the mounting bracket, in accordance with an embodiment of the present disclosure.
Figure 5B:
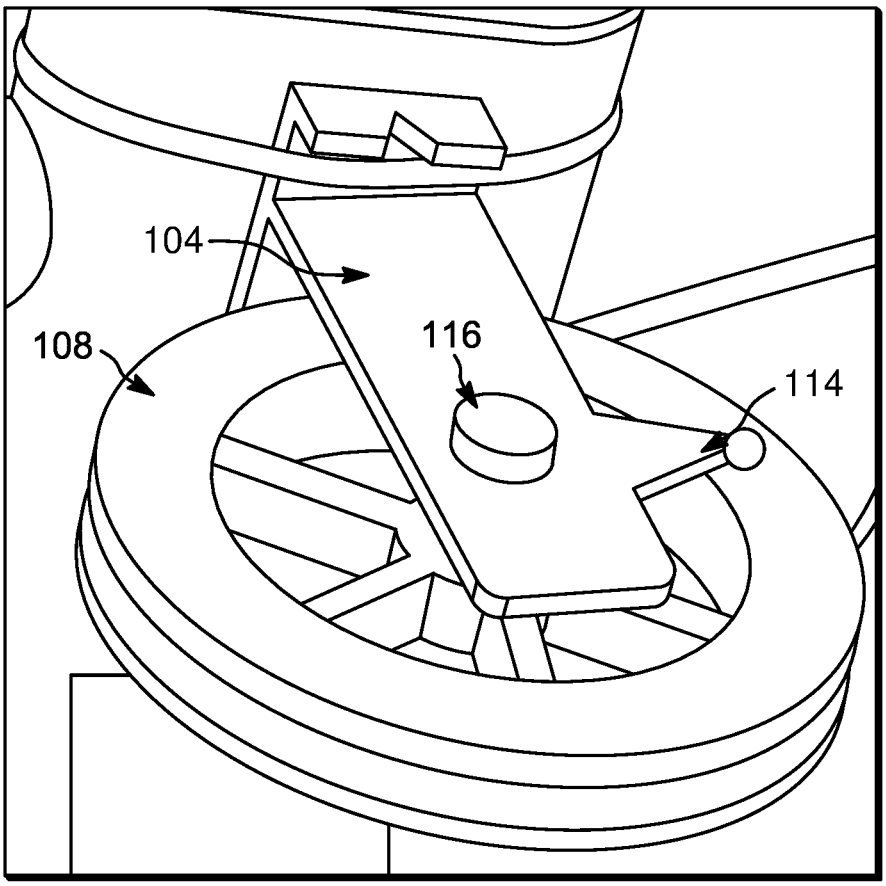
FIG. 5B illustrates a side view of the disk secured inside the mounting bracket, in accordance with an embodiment of the present disclosure.

FIGS. 5A-5B illustrate different views of the disk 108 secured inside the mounting bracket 104 FIG. 5A illustrates a top view of the disk 108 secured inside the mounting bracket 104 and FIG. 5B illustrates a side view of the disk 108 secured inside the mounting bracket 104, in accordance with an embodiment of the present disclosure. This secure fitting of the mounting bracket 104 and the disk 108 also enables the connector 102 to be duly wrapped around the center pulley of the disk 108, with which it extends towards the knob 110.

In an embodiment, upon rotation of the knob 110, the visible numerical marker/marker dot of the disk 108 aligned with the pointer arrow 114 of the mounting bracket 104 corresponds to the estimated resistance of the wheel of the bicycle 102. Thus, the user is provided with a visible indication of the resistance of the wheel while riding the bicycle 102. For instance, during virtual classes when the instructors say, "add 3 to 5" or "change resistance from 20 to 30", the user can easily make the required change as the specific resistance values are clearly visible on the disk 108. Adjusting the resistance knob 110 to the correct resistance level prevents excess exercise when not required, thereby enhancing a fitness benefit of the user. After exercise/workout is completed, the user may calibrate the disk 108 by turning the knob 110 to a minimum resistance and turning the disk 108 to align with a first reference dot to the left of the number 10 on the disk 108. The knob 110 should be turned left-most in order to be aligned with the first reference dot. As the user starts riding the bicycle 102, he/she rotates the knob 110 towards the right. Rotating the knob 110 in a clockwise direction leads to an increase in the resistance level of the wheel and rotating the knob in the counterclockwise direction leads to a reduction in the resistance level of the wheel.

In an embodiment, the resistance of the wheel may be adjustable based on a comfort or a fitness level of the user while riding the bicycle 102. For instance, the user may be cycling at a high resistance level and may experience certain discomforts such as back pain, leg pain, heavy breathing. With the claimed device 100, the user can reduce the resistance to a lower level by rotating the knob 110, where the resistance level is clearly visible on the disk 108. Alternatively, the user may also increase the resistance level if they want to do more rigorous exercise. Thus, the claimed device 100 is easily adjustable based on a fitness level of the user riding the bicycle 102.

In an embodiment, an outside diameter of the center pulley of the disk 108 can be increased or decreased to match a ratio of revolutions of the knob 110 on each type of stationary exercise bicycle 102. This is not adjustable by the user. Instead, the diameter is adjusted before production of the disk 108 by the manufacturer. The ratio is adjusted such that full revolutions of the knob 110 from zero to 100% resistance equals one full rotation of the disk 108.

Figure 6A:
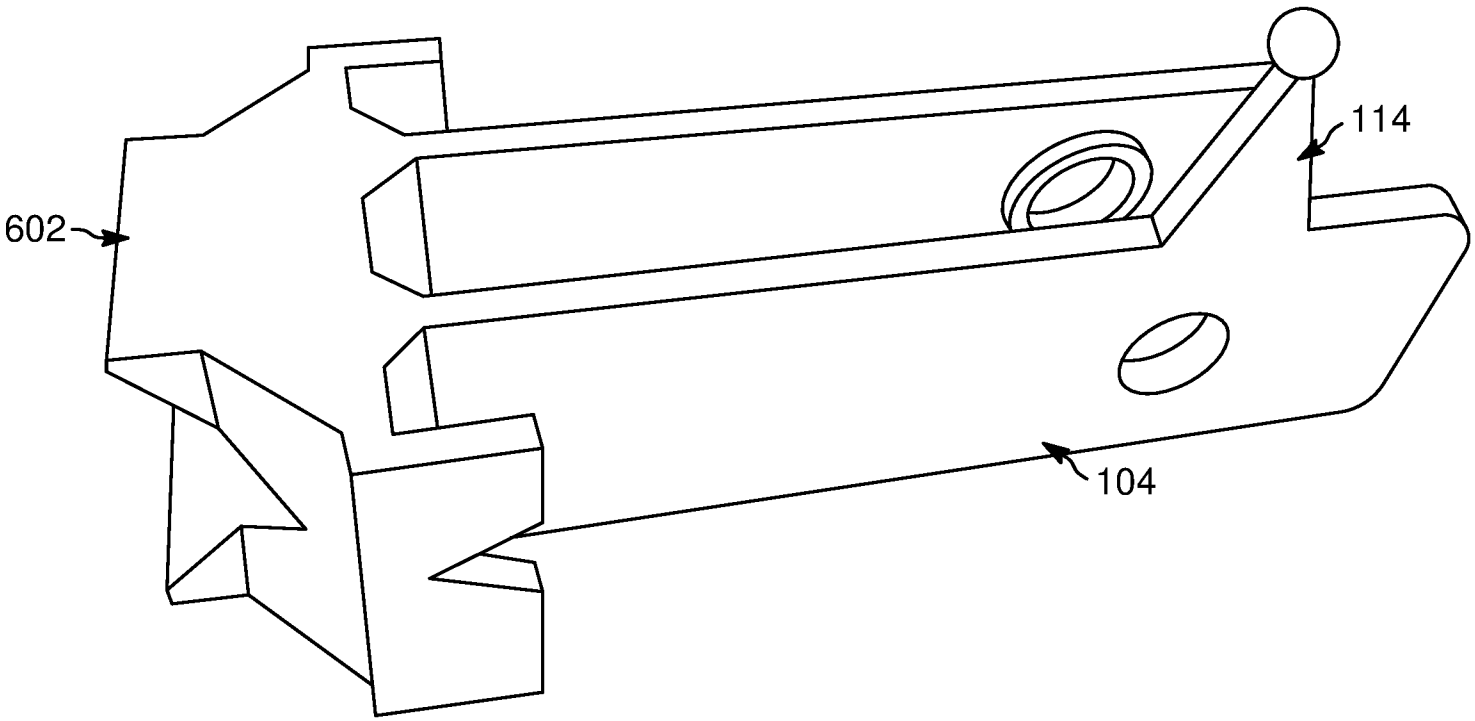
FIG. 6A illustrates a side view of the mounting bracket having a front angled tab, in accordance with an embodiment of the present disclosure.
Figure 6B:
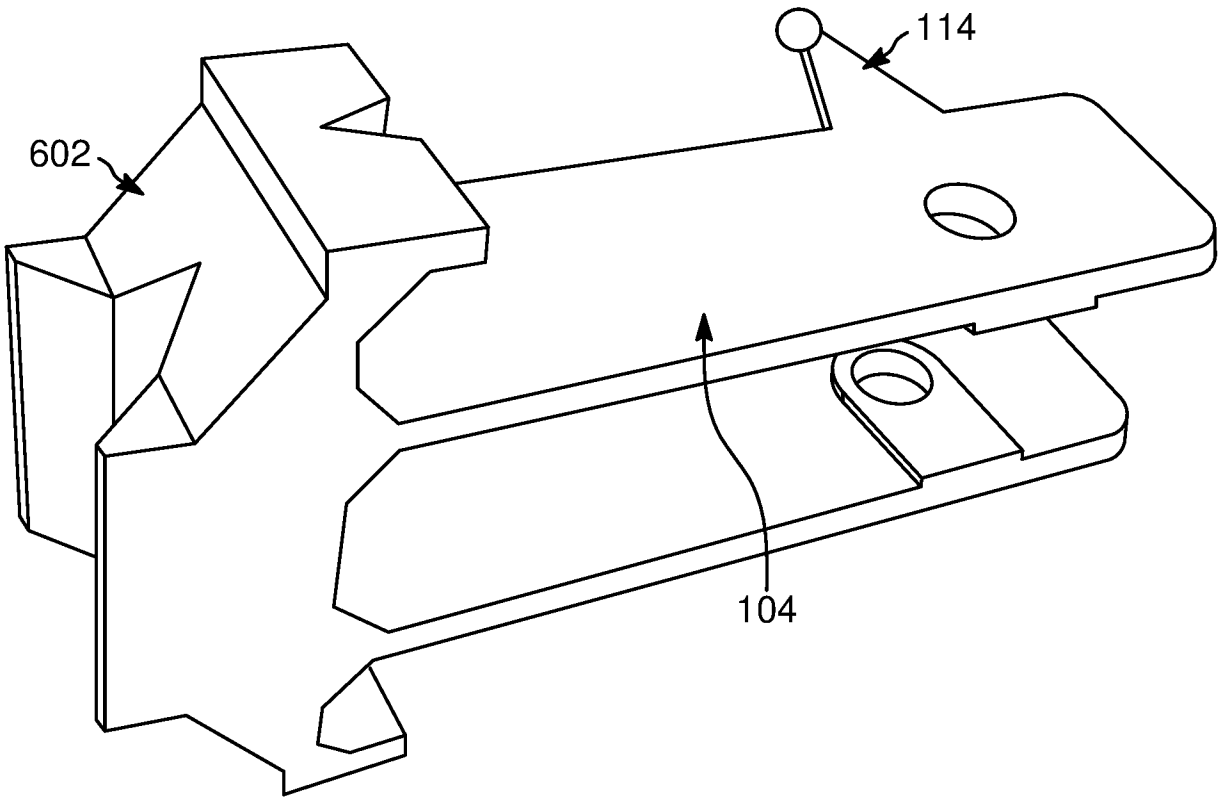
FIG. 6B illustrates a top view of the mounting bracket having the front angled tab, in accordance with an embodiment of the present disclosure.

FIGS. 6A-6B illustrates views of the mounting bracket 104 having a front angled tab 602. FIG. 6A illustrates a side view of the mounting bracket 104 having the front angled tab 602 and FIG. 6B illustrates a top view of the mounting bracket 104 having the front angled tab 602, in accordance with an embodiment of the present disclosure. In one embodiment, the front angle tab 602 may be mounted on a right side of the mounting bracket 104. The front angle tab 602 may have a concave shape on its outer surface. As depicted and explained under FIGS. 1-5, the mounting bracket 104 is perpendicularly coupled to the handlebar post 106, whereas the mounting bracket 104 of FIGS. 6A-6B can be coupled to the handlebar post 106 in an angled manner. The front angle 602 enables the mounting bracket 104 to be coupled to the handlebar post 106 of the bicycle 102 at an angled manner. In an example, the mounting bracket 104 may be coupled to the handlebar post 106 by the front angle tab 602 at an angle of 45 degrees. This angled manner coupling of the mounting bracket 104 to the handlebar post 106 of the bicycle 102 may be useful for some bicycles, such as Schwinn IC3.

Figure 7:
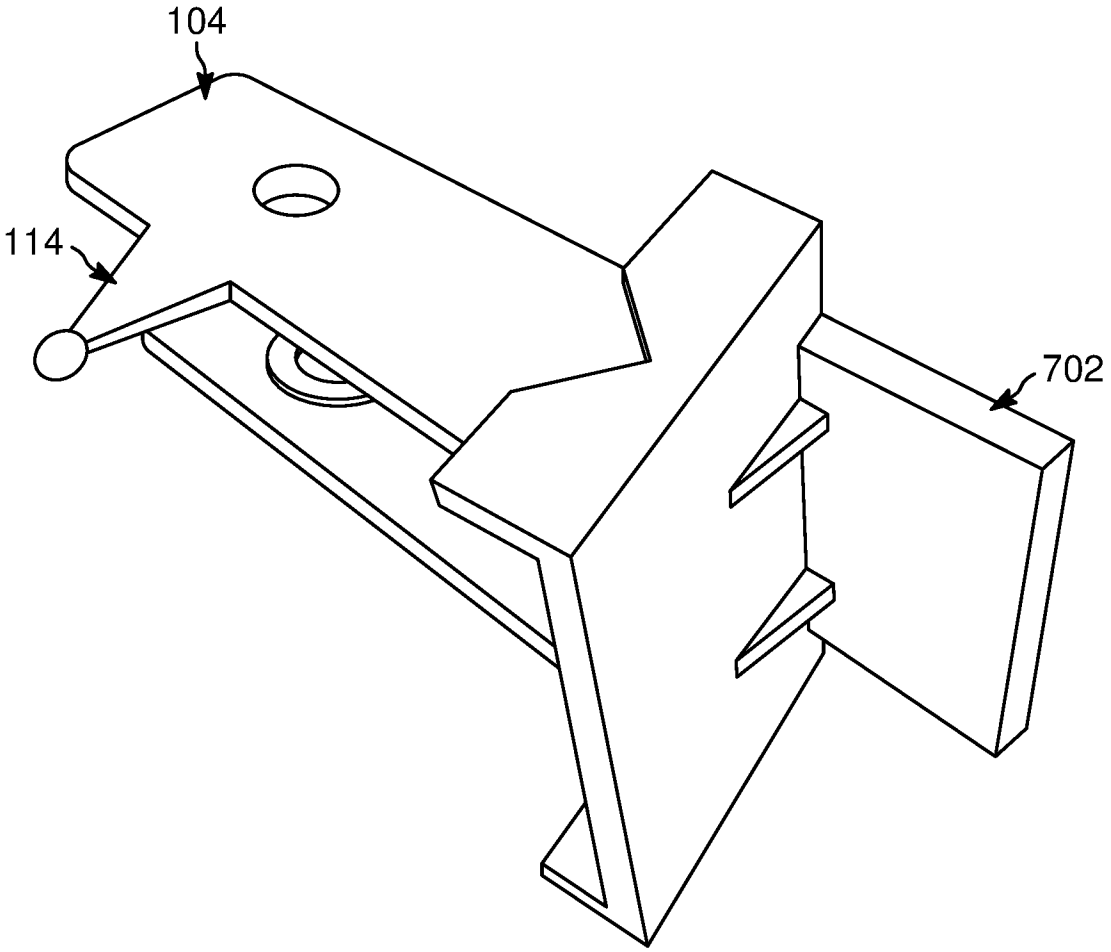
FIG. 7 illustrates a top view of the mounting bracket having a front tab, in accordance with an embodiment of the present disclosure.

FIG. 7 illustrates a top view of the mounting bracket 104 having a front tab 702, in accordance with an embodiment of the present disclosure. In one embodiment, the front tab 702 may be mounted on a right side of the mounting bracket 104. The front tab 702 may be of a square shape, which extends outwards from a top portion of the right side of the mounting bracket 104. The front tab 702 enables the device 100 to be fully forward on a front edge of a frame of the bicycle 102. Thus, the knob 110 may also be connected towards the front edge of the frame of the bicycle 102. As a result, the mounting bracket 102 and knob 110 will not interfere with a range of motion and tension on the connector 112, while the user is riding the bicycle 102.

Figure 8A:
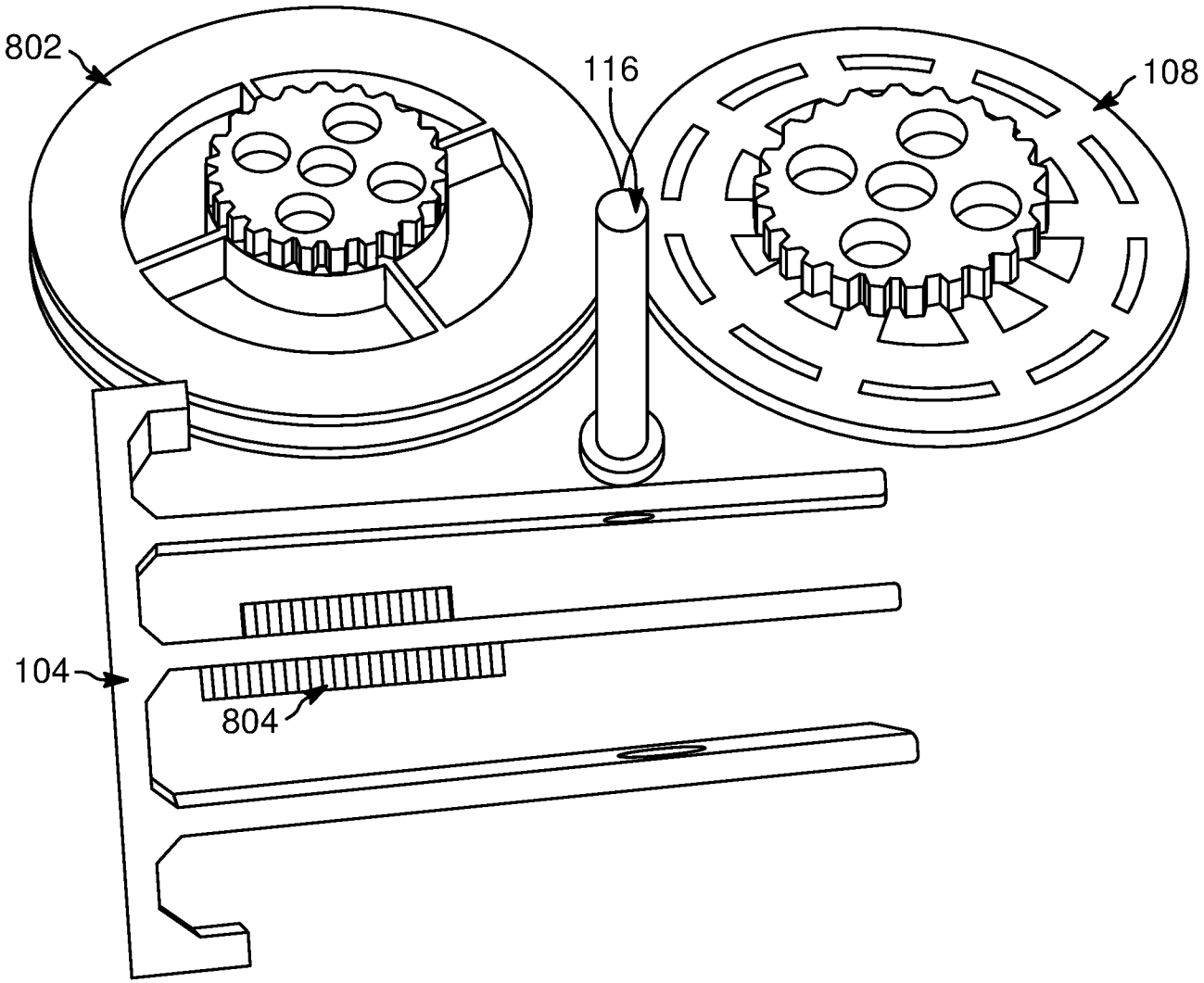
FIG. 8A illustrates a perspective view in which a 2:1 gear reduction component is mounted on the mounting bracket, in accordance with an embodiment of the present disclosure.
Figure 8B:
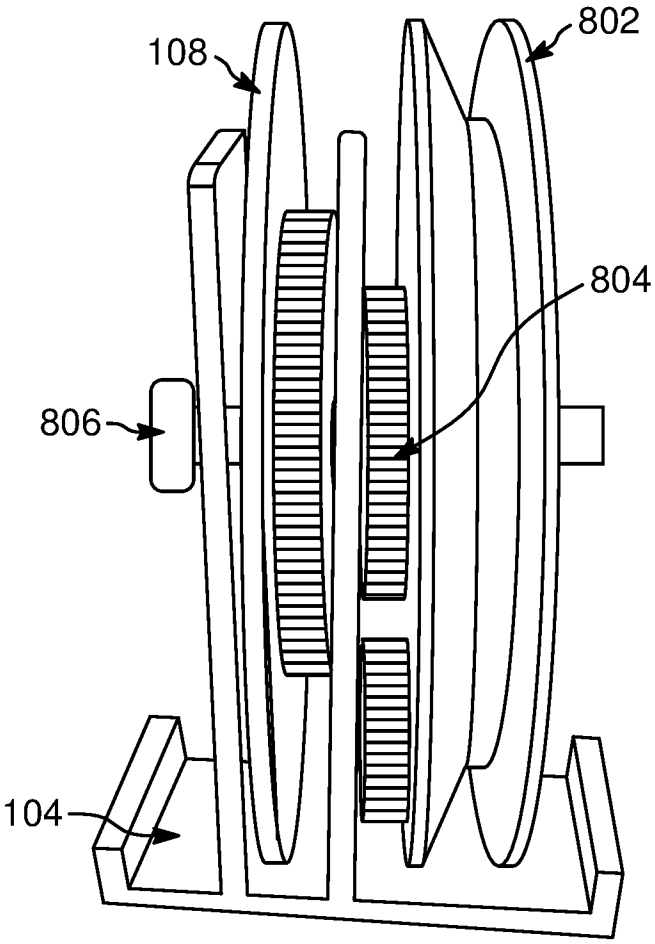
FIG. 8B illustrates a side view of the mounting bracket in which the 2:1 gear reduction component and disk are mounted to it, in accordance with an embodiment of the present disclosure.

FIG. 8A illustrates a perspective view in which a 2:1 gear reduction component 804 is mounted on the mounting bracket 104 and FIG. 8B illustrates a side view of the mounting bracket 104 in which the 2:1 gear reduction component 804 and disk 106 are mounted to it, in accordance with an embodiment of the present disclosure. As mentioned above, six rotations of the knob 110 translates to one full rotation of the disk 108. However, some bicycles, which are generally larger sized bicycles, may require more than six rotations of the knob 110 to translate to one full rotation of the disk 108. Bicycles requiring over 10 rotations/turns may require a gear reduction solution to maintain a device of similar dimensions. For instance, bicycles requiring twelve plus rotations of the knob 110 would require a new solution, and the device 100 described in FIGS. 1-5 would not work effectively. Bicycles requiring a greater number of resistance knob rotations would require a mounting bracket, which is of an increased size. For example, if a bike resistance knob post 806 has a diameter of 10 mm and twelve resistance knob rotations are required for translating to one disk 108 rotation, then the diameter of the disk 108 shall be made to approximately 10×12=120 mm. This size is to large and impractical to design. Also, a disk having such a large diameter would occupy space and may affect the user while riding the bicycle 102.

Thus, introduction of the 2:1 gear reduction component 804 assists in solving the problems mentioned in the above paragraph. As shown in FIG. 8A, the mounting bracket 104 may have three extending portions, where 2:1 gear reduction component 804 is mounted on a second or center extending portion. The 2:1 gear reduction component 804 includes a first gear and a second gear, where the first gear is larger in size than the second gear. The first gear is mounted on one outside portion of the center extending portion and the second gear is mounted on the other side portion of the center extending portion. Both the first gear and the second gear are parallel to each other. The first gear and the second gear may also have center holes that enable the post 116 to pass through them. The post 116 is passed through the center holes of the first and second gears, the mounting hole 302 in the mounting bracket 104, and the center hole 202 in the disk 108, for securing the mounting bracket 104 and the disk 106 in place.

As shown in FIG. 8B, a pulley 802 is mounted on the first gear and the disk 108 is mounted on the second gear. The pulley 802 may have a diameter of about 70 mm and the diameter of the disk 108 may be about 90 mm. In an example, the pulley 802 may be a 6-turn pulley, which works on a twelve plus turn bike. Further, one end of the connector 112 is enclosed around the plastic rod attached to the knob 110 and another end of the connector 112 is enclosed around the pulley 802. Revolutions of the knob 110 are transferred to the pulley 802 and the disk 108 via the connector 112.

Figure 9:
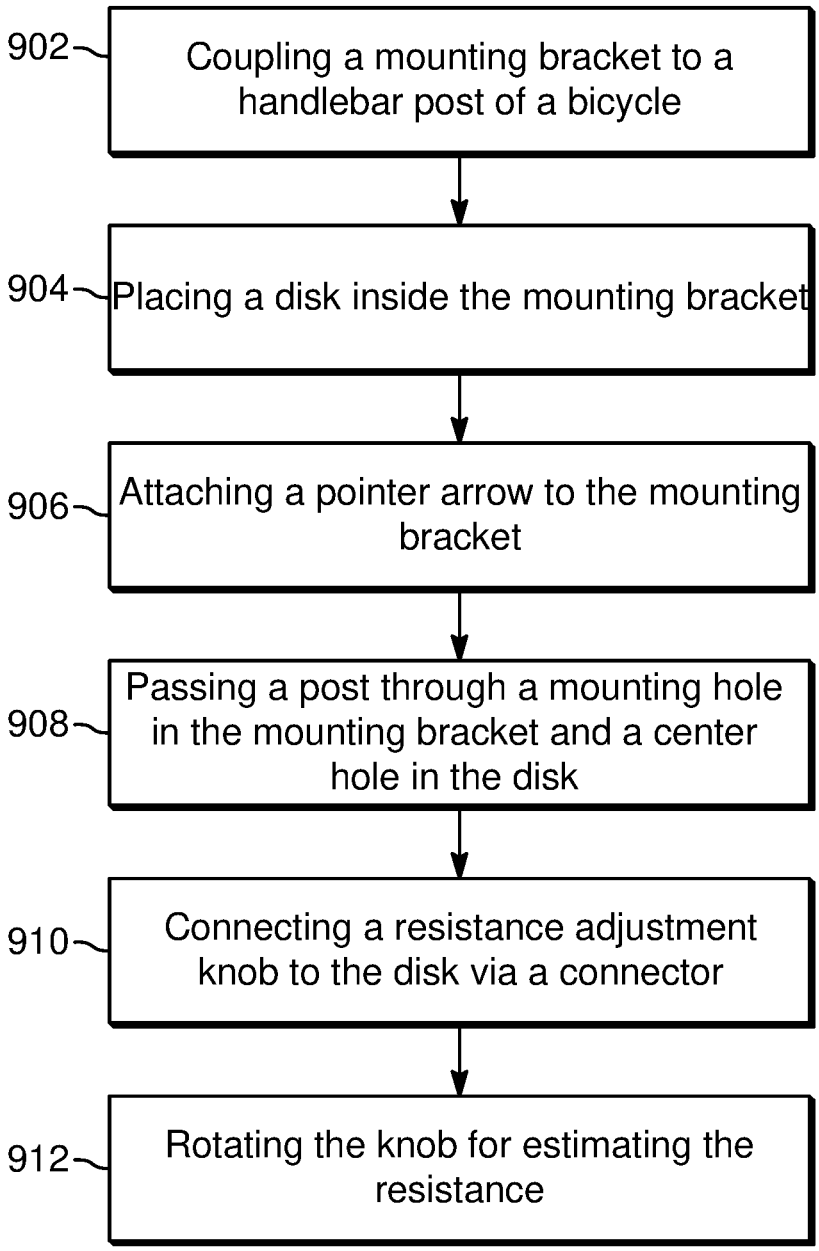
FIG. 9 illustrates a flowchart illustrating a method for estimating a resistance of a wheel of the bicycle, in accordance with an embodiment of the present disclosure.

FIG. 9 illustrates a flowchart illustrating a method 900 for estimating the resistance of the wheel of the bicycle 102, in accordance with an embodiment of the present disclosure. In an example, the bicycle 102 may be a stationary exercise bicycle. The resistance may be estimated for a front wheel of the bicycle 102 or a rear wheel of the bicycle 102.

At step 902, the mounting bracket 104 is coupled to a handlebar post 106 of the bicycle 102 using a fastener. In an example, the fastener may be a zip-tie, a string, a rubber band, and the like. For instance, the mounting bracket 104 is a single plastic unit.

At step 904, the disk 108 is placed inside the mounting bracket 104. The disk 108 is configured to indicate the resistance of the wheel of the bicycle 102. In an example, the disk 108 may be of a circular cross section shape. The disk 108 rotates freely on a horizontal axis inside of the mounting bracket 104.

At step 906, the pointer arrow 114 is attached to a top surface of the mounting bracket 104. In an embodiment, the pointer arrow 114 may also be manufactured into the mounting bracket 104. The pointer arrow 114 is aligned with a center rotation point of the disk 108. For instance, the pointer arrow 114 may be of a triangle shape, having a circular tip at its end. At step 608, the post 116 is passed through the mounting hole 302 in the mounting bracket 104 and the center hole 202 in the disk 108. For instance, the post 116 may be of a pin cylindrical shape. Such passing of the post 116 via the center hole 202 and the mounting hole 302 enable the disk 108 and the mounting bracket 104 to be held tightly in place.

At step 910, the knob 110 is connected to the disk 108 via the connector 112. In an example, the connector 112 may be a zip-tie, a string, a rubber band, and the like. The connection between the disk 108 and the post 116 under the knob 110 would require a long rubber band (aka connector) The knob 110 may be vertically mounted in front of the handlebar post 106. The knob 110 is attached to the bicycle 102 using a long rubber band aka connector. One end of the connector 112 is enclosed around the post 116 under the knob 110 and another end of the connector 112 is enclosed around a center pulley of the disk 108. Further, revolutions of the knob 110 are transferred to the disk 108 via the connector 112. In this way, the connector 112 is flexible and may be easily stretchable.

At step 912, the knob 110 is rotated for estimating the resistance of the wheel of the bicycle 102. Upon rotation of the knob 110, the connector 112 applies a force that rotates the disk 108. The connector 112 causes the disk 108 to rotate. The estimated resistance of the wheel of the bicycle 102 is visible on the disk 108 to a user/rider associated with the bicycle 102.

In an embodiment, an outside edge of a top portion of the disk 108 includes equally spaced numeral markers. The equally spaced numeral markers range from the number 10 to the number 100. Each numeral marker is separated by nine evenly spaced raised marker dots. The numerical markers and marker dots correspond to resistance values of the wheel of the bicycle 102.

Upon rotation of the knob 110, the visible numerical marker/marker dot of the disk 108 aligned with the pointer arrow 114 of the mounting bracket 104 corresponds to the estimated resistance of the wheel of the bicycle 102. Therefore, the user is provided with a clear and visible indication of the resistance of the wheel. For instance, during virtual classes when the instructors say, "add 3 to 5" or "change resistance from 20 to 30", the user can easily shift between resistance values as the specific resistance values are clearly visible on the disk 108.

Further, the disk 108 and the knob 110 both simultaneously rotate in a same rotation direction. For instance, if the knob 110 rotates in a clockwise direction, the disk 108 also rotates in the clockwise direction. If the knob 110 is rotated in a counterclockwise direction, the disk 108 also rotates in the counterclockwise direction. Generally, rotating the knob 110 in the clockwise direction leads to an increased resistance of the wheel and rotating the knob 110 in the counterclockwise direction leads to a decreased resistance of the wheel of the bicycle 102. Also, the disk 108 and the knob 110 both rotate at nearly equivalent speeds.

The device and method described herein above has several technical advantages. Turning the stationary bicycle resistance knob in the general direction of desired resistance would seem to be sufficient. Without a visual indication, estimating the resistance from minimum to maximum is not effective. The device and method described herein provides the user with a visual reference to better estimate resistance of the wheel based on number of rotations of the resistance adjustment knob on the stationary bicycle. Underestimating the resistance in use is common among stationary bicycle users. This natural tendency leads to a decrease in the health benefit of each exercise session. Therefore, in the subject invention, effective use of exercise bicycle resistance is maintained to provide increased exercise intensity and increased health benefit of time using the stationary bicycle. In summary, with the resistance estimation device attached to a stationary bicycle, the user has a visual reference estimation of resistance selected on the bicycle. Further, the device and method is capable in working on over 40 exercise bike models.

The device and method described herein further enables the resistance of the wheel to be adjustable based on a comfort or a fitness level of the user while riding the bicycle. For instance, the user may be cycling at a high resistance level and may experience certain discomforts such as back pain, leg pain, heavy breathing. With the device and method described herein, the user can reduce the resistance to a lower level by rotating the knob, where the resistance level is clearly visible on the disk. Vice versa, the user may also increase the resistance level if they want to do more rigorous exercise. Thus, the device is easily adjustable based on a fitness level of the user riding the bicycle.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A device for determining a resistance of a wheel of a bicycle, the device comprising:

a mounting bracket coupled to the bicycle;

a disk that is configured to indicate the resistance, wherein the disk is located within the mounting bracket; and a resistance adjustment knob that is connected to the disk via a connector, wherein upon rotation of the resistance adjustment knob, the connector rotates the disk for determining the resistance of the wheel of the bicycle, wherein the determined resistance is visible on the disk.

2. The device as claimed in claim 1, further comprising a post that is configured to pass through a mounting hole in the mounting bracket and a center hole in the disk, for securing the disk in place.

3. The device as claimed in claim 1, wherein the mounting bracket is designed as a single plastic unit.

4. The device as claimed in claim 1, wherein the connector is a zip-tie, a rubber band, a string, or a combination thereof.

5. The device as claimed in claim 1, wherein the mounting bracket is coupled to a handlebar post of the bicycle using a fastener.

6. The device as claimed in claim 5, wherein the fastener is a zip-tie, a rubber band, a string, or a combination thereof.

7. The device as claimed in claim 1, wherein upon rotation of the resistance adjustment knob, the disk simultaneously rotates in a same rotation direction as the resistance adjustment knob.

8. The device as claimed in claim 1, wherein an outside edge of a top portion of the disk comprises equally spaced visible numeral markers ranging from ten to hundred, each numeral marker separated by nine evenly spaced raised marker dots, and wherein the numeral markers and marker dots correspond to resistance values of the wheel.

9. The device as claim in claim 8, wherein the mounting bracket comprises a pointer arrow configured, wherein the pointer arrow is positioned parallelly above the visible numeral markers on the top portion of the disk.

10. The device as claim in claim 9, wherein during rotation of the resistance adjustment knob, the visible numeral marker aligned with the pointer arrow corresponds to the determined resistance of the wheel that is visible to a user.

11. The device as claim in claim 10, wherein the resistance of the wheel can be adjustable by rotating the knob based on a comfort of the user while riding the bicycle.

12. A device for estimating a resistance of a wheel of a bicycle, the device comprising:

a mounting bracket configured to be coupled to the bicycle;

a disk that is configured to indicate the resistance, wherein the disk is located inside the mounting bracket;

wherein the disk is configured to be connected to a resistance adjustment knob on the bicycle via a connector;

a pointer arrow attached to the mounting bracket, wherein the pointer arrow is positioned parallelly above the disk; and wherein an outside edge of a top portion of the disk comprises equally spaced visible numeral markers ranging from ten to hundred, each numeral marker separated by nine evenly spaced raised marker dots, wherein the numeral markers and marker dots correspond to resistance values of the wheel, and wherein upon rotation of the resistance adjustment knob, the connector rotates the disk, and wherein the visible numeral marker aligned with the pointer arrow corresponds to the estimated resistance of the wheel that is visible on the disk.

13. The device as claimed in claim 12, further comprising a post that is configured to pass through a mounting hole in the mounting bracket and a center hole in the disk, for securing the disk in place.

14. The device as claimed in claim 12, wherein the mounting bracket is designed as a single plastic unit.

15. The device as claimed in claim 12, wherein the connector is a zip-tie, a rubber band, a string, or a combination thereof.

16. The device as claimed in claim 12, wherein the mounting bracket is coupled to a handlebar post of the bicycle using a fastener.

17. The device as claimed in claim 16, wherein the fastener is a zip-tie, a rubber band, a string, or a combination thereof.

18. The device as claimed in claim 12, wherein upon rotation of the resistance adjustment knob, the disk simultaneously rotates in a same rotation direction as the resistance adjustment knob.

19. The device as claim in claim 12, wherein the resistance of the wheel can be adjustable by rotating the resistance adjustment knob based on a comfort of a user while riding the bicycle.

20. A method for estimating a resistance of a wheel of a bicycle, the method comprising:

coupling a mounting bracket to a handlebar post of the bicycle;

placing a disk that is configured to indicate the resistance inside the mounting bracket;

attaching a pointer arrow to the mounting bracket, wherein the pointer arrow is positioned parallelly above the disk;

passing a post through a mounting hole in the mounting bracket and a center hole in the disk, for securing the disk in place;

connecting a resistance adjustment knob to the disk via a connector, wherein an outside edge of a top portion of the disk comprises equally spaced visible numeral markers ranging from ten to hundred, each numeral marker separated by nine evenly spaced raised marker dots, wherein the numeral markers and marker dots correspond to resistance values of the wheel; and rotating the resistance adjustment knob for estimating the resistance of the wheel, wherein upon rotation, the connector rotates the disk and the visible numeral marker aligned with the pointer arrow corresponds to the estimated resistance of the wheel that is visible on the disk.

* * * * *